United States Patent [19]

Sailors, Jr.

[11] 4,311,173

[45] Jan. 19, 1982

[54] AIR FLOW BAG PACKER SPOUT AND HOOD ASSEMBLY

[75] Inventor: Clyde A. Sailors, Jr., Houston, Tex.

[73] Assignee: Continental Carbon Company, Houston, Tex.

[21] Appl. No.: 126,650

[22] Filed: Mar. 3, 1980

[51] Int. Cl.[3] ..... B65B 1/18

[52] U.S. Cl. ..... 141/68; 141/93; 141/286; 141/315

[58] Field of Search ..... 53/469, 570; 141/10, 141/59, 67, 68, 93, 285, 286, 290, 314–317, 392

[56] References Cited

U.S. PATENT DOCUMENTS 3,137,328 6/1964 Swenson et al. ..... 141/315

FOREIGN PATENT DOCUMENTS 2032380 5/1980 United Kingdom ..... 141/68

*Primary Examiner*—Frederick R. Schmidt

*Attorney, Agent, or Firm*—Jerry B. Peterson

[57] ABSTRACT

A spout and hood assembly for an air flow bag packer in which the spout consists of an inner product supply tube surrounded by a shell providing a vent area to which a vacuum is supplied to evacuate the air from the bag as it is filled. The shell is tapered and oval-shaped to conform to the bag sleeve and so that the vent area cross section increases toward the vacuum source to prevent plugging of the vent area. The bottoms of the supply tube and the shell engage one another to reduce the possibility of any product escaping through the vent system during the filling cycle. The spout is affixed to and surrounded by a generally cylindrical dust hood which is also vented to a dust collection system. A dust shield, attached within the hood, surrounds the spout with a clearance so as to provide a venturi effect to better draw any dust into the dust collection system.

9 Claims, 9 Drawing Figures

AIR FLOW BAG PACKER SPOUT AND HOOD ASSEMBLY

BACKGROUND OF THE INVENTION

This invention relates to the art of dispensing dry particulate solid materials into bags by means of air flow bag packers. More particularly, it relates to a spout and hood assembly designed to control dust and relieve pressure from within bags such as paper and polyethylene valve bags as they are filled with such solid materials from a conventional air flow packer.

The need for this invention arose because of the difficulty of filling polyethylene bags with carbon black at an acceptable rate. Additionally, stringent environmental regulations dictated that escaping dust be controlled.

In the carbon black industry, the carbon black from the reactors is separated from the waste gases in bag filters, after which it is pelletized, dried, and placed into storage. From storage it is shipped for sale either in bulk or in bags. For bag shipments, the dry pellets are usually fluidized with air in an air flow packer such as the apparatus described in U.S. Pat. No. 3,083,780 and then discharged into bags.

During the bag-filling operation, the bags become filled with air, and it is therefore important to discharge the air from within the bag not only to control the amount of dust from the pellets but to prevent the bag from bursting. The objects of this invention are to eliminate or minimize these problems.

BRIEF SUMMARY OF THE INVENTION

This invention in one aspect comprises a spout and hood assembly, for an air flow bag packer in which the spout consists of an inner product supply tube surrounded by a shell providing a vent area to which a vacuum is supplied to evacuate the air from the bag as it is filled. The shell is tapered and oval-shaped to conform to the bag sleeve and so that the vent area cross section increases toward the vacuum source to prevent plugging of the vent area. The bottoms of the supply tube and the shell engage one another to reduce the possibility of any product escaping through the vent system during the filling cycle. The spout is affixed to and surrounded by a generally cylindrical dust hood which is also vented to a dust collection system. A dust shield, attached within the hood, surrounds the spout with a clearance so as to provide a venturi effect to better draw any dust into the dust collection system. In another aspect, the invention comprises the spout assembly itself or in combination with a dust hood of another design. In still another aspect, the invention comprises the dust hood itself or in combination with a spout of another design.

DESCRIPTION OF THE PREFERRED EMBODIMENTS

Figures 1, 2, 3, 4, 5:
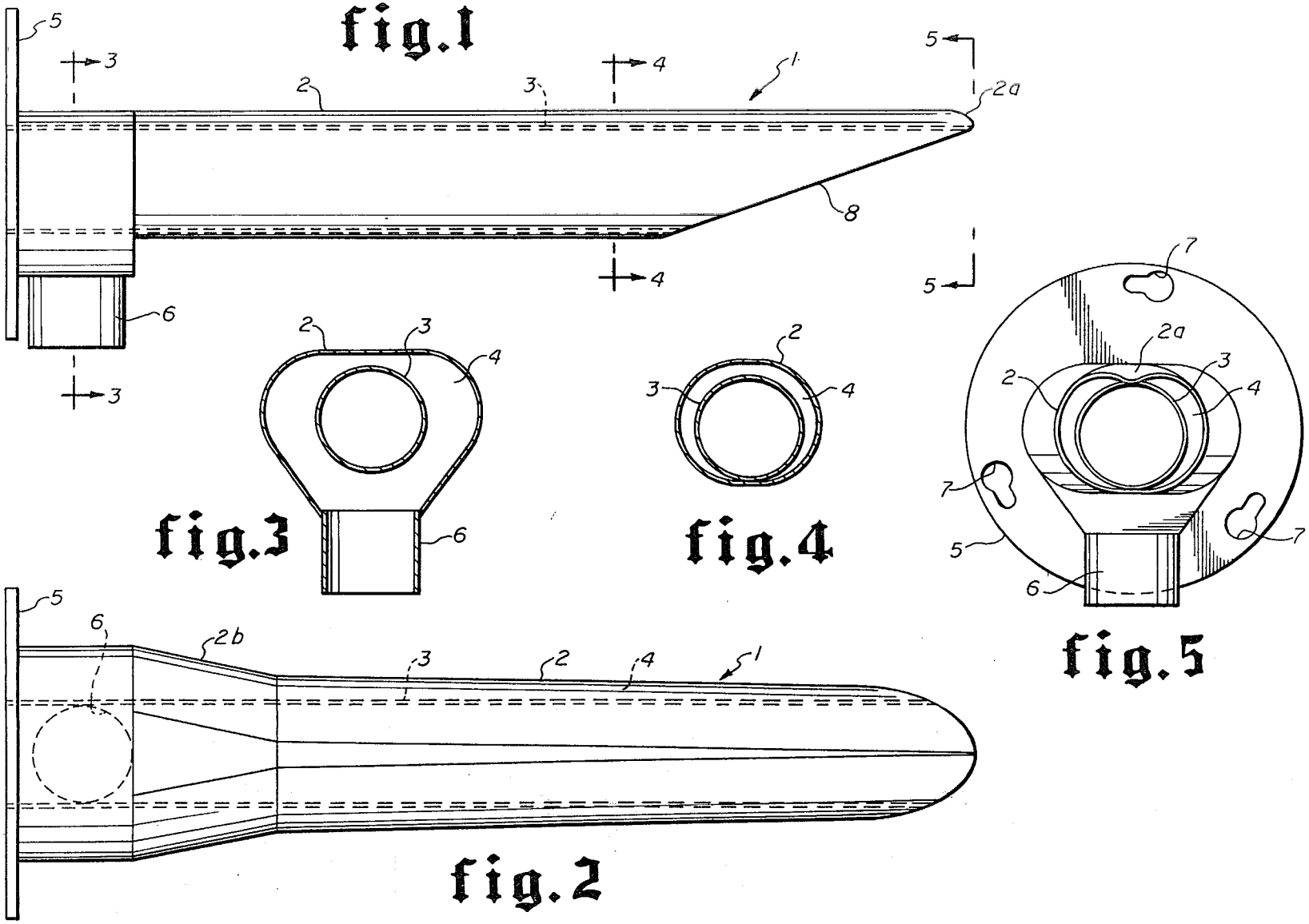
FIG. 1 is a side elevational view of the spout assembly.
FIG. 2 is a plan view of the spout assembly.
FIG. 3 is a sectional view along the line 3—3 of FIG. 1.
FIG. 4 is a sectional view along the line 4—4 of FIG. 1.
FIG. 5 is an end elevation view of the spout assembly taken along the lines 5—5 of FIG. 1.

Referring to FIGS. 1–5, the spout assembly comprises outer shell 2, product supply tube 3, tapered vent area 4 defined by shell 2 and tube 3, mounting flange 5, and internal bag pressure relief connection 6. Shell 2 and tube 3 are affixed to flange 5 for example by welding.

Mounting holes 7 are for mounting the spout assembly onto the dust hood assembly (described below).

As shown in FIG. 1, the ends of the tube 3 and shell 2 conform to one another in an inclined edge 8 to facilitate insertion of the spout into the bag sleeve and to facilitate discharge of the dry material into the bag.

The nose **2*a* of shell 2** is preferably tapered downwardly to facilitate insertion into the sleeve at the top of the bag preparatory to filling the bag with product.

As shown in FIG. 2, the outer shell 2 is tapered to facilitate insertion of the spout into the sleeve at the top of the bag preparatory to filling the bag with product. Another advantage of the taper is to provide the tapered vent area 4 to be described below in greater detail.

Outer shell 2 is of oval-shaped cross section in a horizontal plane as shown in FIGS. 4–5 to better conform to the sleeves of the bags being filled. Section **2*b* is preferably of accentuated taper and oval shape, as shown in FIGS. 2–3**.

The outer shell 2 can be fabricated to fit bag sleeves of any size without comprising performance.

Pressure relief connection 6, which connects with vent area 4, is connected to a dust collection system (not shown) so that a controlled vacuum can be applied to the bag during the filling thereof so that the air will evacuate from within the bag at the same rate air and product are introduced into the bag. As is well known in the art, air flow-packers inherently introduce air, along with product, into the bag during the filling operation. See U.S. Pat. No. 3,083,780 for an example of a prior art air flow packer.

The vent area 4 is tapered to provide an increasing area cross section from the spout inlet (right end of spout 1 in FIGS. 1 and 2) to the opposite end of the spout, which prevents plugging of the air passage defined by the vent area.

As shown in FIG. 4, the vent area at the bottom of the spout is reduced to zero where product tube 3 engages outer shell 2, thus reducing the possibility of any product escaping during the filling cycle.

The spout design allows the internal venting of air from either polyethylene or paper valve bags at the same rate as they are being filled with product, thus minimizing the problem of escaping dust and at the same time allowing the bags to be filled at an acceptable rate. In addition, the evacuation of air from within the bags is so effective that it removes all risk of bursting the bags during the filling operation.

Figure 7:
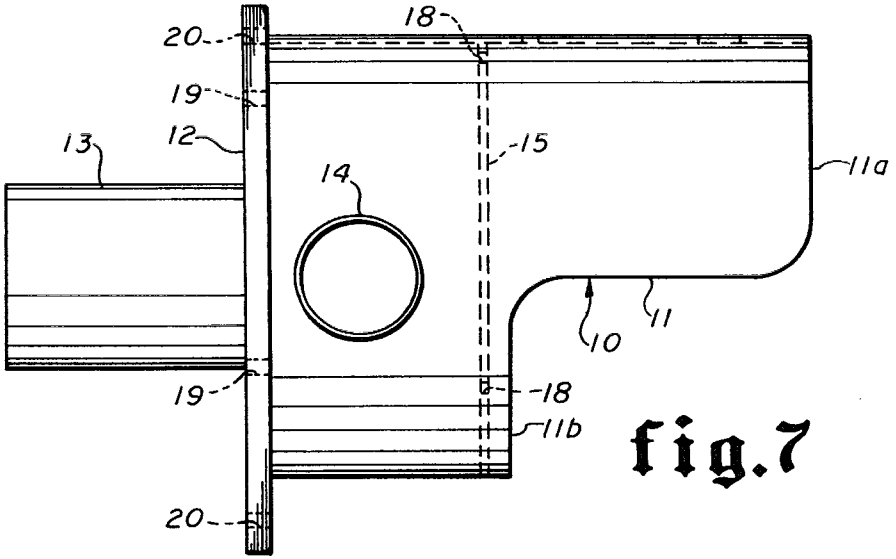
FIG. 7 is a side elevation view of the dust hood assembly.
Figure 6:
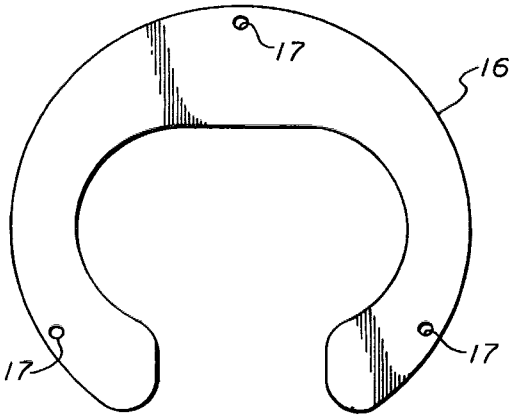
FIG. 6 is a full view of the dust shield.
Figure 8:
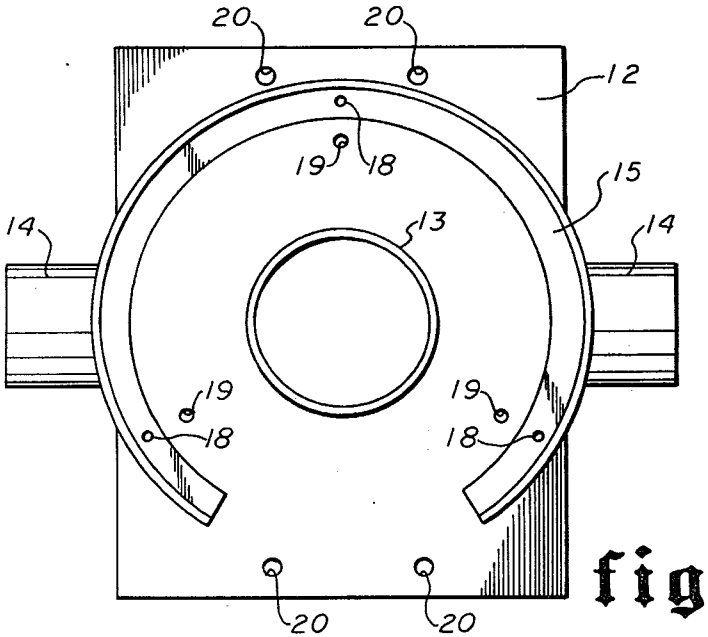
FIG. 8 is an end elevation view of the dust hood assembly taken along the line 8—8 of FIG. 7.

Turning to FIGS. 6–8, comprising the dust hood assembly, this assembly is preferably used in combination with the spout assembly of FIGS. 1–5 but could be used in combination with spout assemblies of other designs. The purpose of the dust hood is to minimize escape of dust which will otherwise occur in spite of the use of the spout assembly of FIGS. 1–5, due to improper operator performance or unavoidable upsets in operation.

Figure 9:
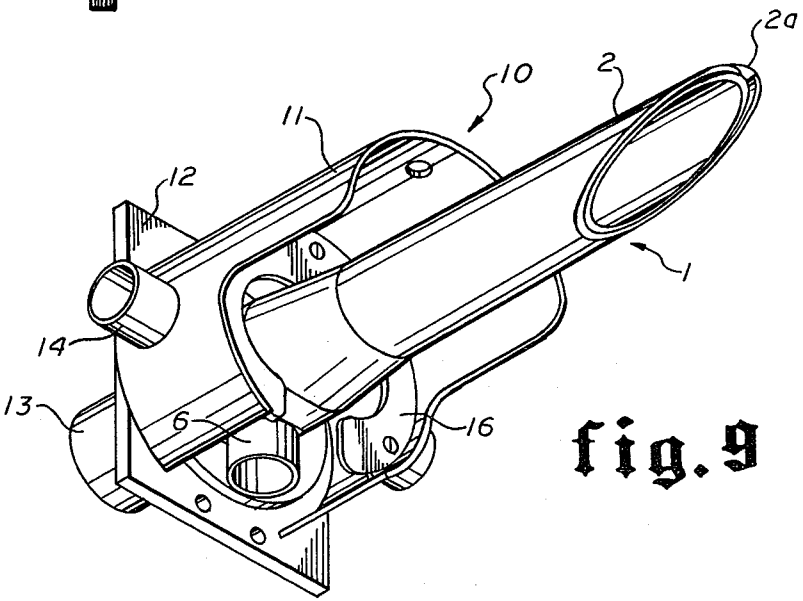
FIG. 9 is a perspective view of the entire spout and dust hood assembly.

The dust hood 10 comprises generally cylindrical hood 11 welded to mounting plate 12, product supply tube 13 welded to mounting plate 12, hood vacuum hose connections 14, and dust shield mounting ring 15 to which dust shield 16 is attached as for example by means of screws and holes 17 and 18. Hood 11 is described as "generally" cylindrical because: (1) as shown in FIGS. 8 and 9, the hood is of incomplete circular configuration at the bottom to accommodate connection 6 when the spout assembly is connected to the dust hood assembly; and (2) edge 11*b* of the open end of the hood is recessed from edge 11*a* to permit the bag to be properly inserted onto the spout. Edge 11*a* is extended to permit affixing thereto a bag clamp (not shown).

As shown in FIG. 8, mounting plate 12 has an orifice of a diameter equal to and conforming to the inside diameter of product supply tube 13.

Hose connectors 14 are connected to a dust collection system (not shown) so that suction can be applied within the hood. Preferably two such connectors 14 are provided so that the suction will be equally distributed within the hood.

FIG. 8 shows how the spout assembly is mounted onto the mounting plate 12, as for example by means of holes 7 and 19 and screws, and also shows how dust shield 16 is attached to dust shield mounting ring 15.

The dust shield 16, designed to fit around the spout as shown in FIG. 9 when the complete assembly is in use, provides a configuration which results in a venturi effect when suction is applied within the hood so that any escaping dust is effectively drawn into the hood, then into connectors 14 and finally into the dust collecting system. This configuration is provided by a clearance of approximately $\frac{1}{4}''$–1", preferably $\frac{5}{8}''$–$\frac{1}{2}''$ between the outside shell 2 and the inside edge of dust shield 16. The clearance selected will depend upon the available air flow of the dust collecting system.

The entire spout and dust hood assembly is attached to the packer (not shown) for example by means of screws through holes 20 in mounting plate 12.

While I have thus described the preferred embodiments of the present invention, many variations will be suggested to those skilled in the art. The foregoing description and examples should therefore not be considered limitative; and all such variations and modifications as are in accord with the principles described are meant to fall within the scope of the appended claims.

I claim:

1. A spout and hood assembly for an air flow bag packer comprising:

an elongate horizontally-disposed filling spout comprising a first product supply tube of circular cross section surrounded by an outer tubular shell having oval-shaped cross section in a horizontal plane, said supply tube and shell terminating at their discharge ends in the form of an inclined edge facing downwardly;

the outer bottom surface of said supply tube engaging the inner bottom surface of said shell;

said shell being tapered to provide a space between said supply tube and said shell which defines a vent area therebetween of area cross section which increases from said inclined edge toward the opposite end of said spout;

said opposite ends being affixed to a mounting flange, said flange having a circular orifice therethrough of the same diameter of the inner diameter of said supply tube;

a pressure relief connection connected to said outer shell in communication with said vent area at said opposite end of said shell;

a dust hood assembly comprising a hollow generally cylindrical hood open at one end and affixed to a mounting plate at the opposite end, said hood being of incomplete circular configuration at the bottom thereof; said mounting plate having an orifice therethrough; a second product supply tube affixed to the outside of said mounting plate and sharing a common axis with said hood, the inside diameter of said second supply tube being equal to and conforming to the diameter of said mounting plate orifice; at least one cylindrical connector affixed to the side of said hood adjacent said mounting plate; a generally circular dust shield mounting ring affixed to the inside of said hood between the said connectors and the open end of said hood; and a flat dust shield, affixed to said dust shield mounting ring, said dust shield being of generally circular outside configuration and an inside configuration conforming to but greater in size than the outside configuration of said outer shell of said spout; said mounting ring and said dust shield being of incomplete circular configuration at their bottom portions conforming to the incomplete circular configuration of said hood.

2. The assembly of claim 1 in which there are two of said cylindrical connectors.

3. A spout and hood assembly for an air flow bag packer comprising:

an elongate horizontally-disposed filling spout comprising a product supply tube of substantially circular cross section, said supply tube terminating at its discharge end in the form of an inclined edge facing downwardly;

the opposite end of said tube being affixed to a mounting flange, said flange having a circular orifice therethrough of the same diameter of the inner diameter of said supply tube;

a dust hood assembly comprising a hollow generally cylindrical hood open at one end and affixed to a mounting plate at the opposite end, said hood being of incomplete circular configuration at the bottom thereof; said mounting plate having an orifice therethrough; a second product supply tube affixed to the outside of said mounting plate and sharing a common axis with said hood, the inside diameter of said second supply tube being equal to and conforming to the diameter of said mounting plate orifice; at least one cylindrical connector affixed to the side of said hood adjacent said mounting plate; a generally circular dust shield mounting ring affixed to the inside of said hood between the said connectors and the open end of said hood; and a flat dust shield, affixed to said dust shield mounting ring, said dust shield being of generally circular outside configuration and an inside configuration conforming to but greater in size than the outside configuration of said spout; said mounting ring and said dust shield being of incomplete circular configuration at their bottom portions conforming to the incomplete circular configuration of said hood.

4. The assembly of claim 3 in which there are two of said cylindrical connectors.

5. A spout and hood assembly for an air flow bag packer comprising:

an elongate horizontally-disposed filling spout comprising a first product supply tube of circular cross section surrounded by an outer tubular shell having oval-shaped cross section in a horizontal plane, said supply tube and shell terminating at their discharge ends in the form of an inclined edge facing downwardly;

the outer bottom surface of said supply tube engaging the inner bottom surface of said shell;

said shell being tapered to provide a space between said supply tube and said shell thus defining a vent area therebetween of area cross section which increases from said inclined edge toward the opposite end of said spout;

the outer side surfaces of said supply tube and the inner side surfaces of said shell being spaced apart at their discharge ends providing an opening to said space between said supply tube and said shell;

said opposite ends being affixed to a mounting flange, said flange having a circular orifice therethrough of the same diameter of the inner diameter of said supply tube;

a pressure relief connection connected to said outer shell in communication with said vent area at said opposite end of said shell;

a dust hood assembly comprising a hollow generally cylindrical hood open at one end and affixed to a mounting plate at the opposite end, said hood being of incomplete circular configuration at the bottom thereof; said mounting plate having an orifice therethrough; a second product supply tube affixed to the outside of said mounting plate and sharing a common axis with said hood, the inside diameter of said second supply tube being equal to and conforming to the diameter of said mounting plate orifice; and at least one cylindrical connector affixed to the side of said hood adjacent said mounting plate.

6. The assembly of claim 5 in which there are two of said cylindrical connectors.

7. A spout assembly for an air flow bag packer comprising:

an elongate horizontally-disposed filling spout comprising a first product supply tube of circular cross section surrounded by an outer tubular shell having oval-shaped cross section in a horizontal plane, said supply tube and shell terminating at their discharge ends in the form of an inclined edge facing downwardly;

the outer bottom surface of said supply tube engaging the inner bottom surface of said shell;

said shell being tapered to provide a space between said supply tube and said shell thus defining a vent area therebetween of area cross section which increases from said inclined edge toward the opposite end of said spout;

the outer side surfaces of said supply tube and the inner side surfaces of said shell being spaced apart at their discharge ends providing an opening to said space between said supply tube and said shell;

said opposite ends being affixed to a mounting flange, said flange having a circular orifice therethrough of the same diameter of the inner diameter of said supply tube; and a pressure relief connection connected to said outer shell in communication with said vent area at said opposite end of said shell.

8. A dust hood assembly for an air flow bag packer comprising:

a hollow generally cylindrical hood open at one end and affixed to a mounting plate at the opposite end, said hood being of incomplete circular configuration at the bottom thereof; said mounting plate having an orifice therethrough; a second product supply tube affixed to the outside of said mounting plate and sharing a common axis with said hood, the inside diameter of said second supply tube being equal to and conforming to the diameter of said mounting plate orifice; at least one cylindrical connector affixed to the side of said hood adjacent said mounting plate; a generally circular dust shield mounting ring affixed to the inside of said hood between the said connectors and the open end of said hood; and a flat dust shield, affixed to said dust shield mounting ring, said dust shield being of generally circular outside configuration and an inside configuration conforming to but greater in size than the outside configuration of said outer shell of said spout; said mounting ring and said dust shield being of incomplete circular configuration at their bottom portions conforming to the incomplete circular configuration of said hood.

9. The assembly of claim 8 in which there are two of said cylindrical connectors.

* * * * *